United States Patent [19]

DuBois

[11] 4,146,004

[45] Mar. 27, 1979

[54] INTERNAL COMBUSTION ENGINE INCLUDING SPARK PLUG ANTI-FOULING MEANS

[75] Inventor: Edmund H. DuBois, Zion, Ill.

[73] Assignee: Outboard Marine Corporation, Waukegan, Ill.

[21] Appl. No.: 718,971

[22] Filed: Aug. 30, 1976

[51] Int. Cl.[2] ..... F02P 13/00

[52] U.S. Cl. ..... 123/169 PH; 123/191 R; 123/193 CH

[58] Field of Search ..... 123/32 SP, 32 C, 65 PD, 123/169 R, 169 CL, 169 P, 169 PA, 169 PH, 191 R, 191 S, 193 R, 193 CH, 193 C, 193 H, 30 C, 65 W, 65 WA, 73 A, 73 E

[56] References Cited

U.S. PATENT DOCUMENTS

| | | | |
|---|---|---|---|
| 1,129,028 | 2/1915 | Van Dyke | 123/191 M |
| 1,438,927 | 12/1922 | Leifheit | 123/191 L |
| 1,609,898 | 12/1926 | Beasley | 123/191 L |
| 2,025,202 | 12/1935 | Harper | 123/191 M |
| 2,154,975 | 4/1939 | Dufour | 123/191 R |
| 2,254,438 | 9/1941 | McCarthy | 123/65 W |
| 2,422,610 | 6/1947 | Bagnulo | 123/32 SP |
| 2,693,082 | 11/1954 | Arthur | 313/143 |
| 2,760,467 | 8/1956 | August | 123/34.1 |
| 3,195,524 | 7/1965 | Heidner | 123/73 A |
| 4,048,974 | 9/1977 | Seifert et al. | 123/191 M |

FOREIGN PATENT DOCUMENTS

| | | | |
|---|---|---|---|
| 687766 | 8/1930 | France | 123/191 M |

*Primary Examiner*—Charles J. Myhre
*Assistant Examiner*—Craig R. Feinberg
*Attorney, Agent, or Firm*—Michael, Best & Friedrich

[57] ABSTRACT

Disclosed herein is an internal combustion engine including an ignition port having an outlet opening into a cylinder combustion chamber, a spark plug mounted in the ignition port, and a deflector located on the cylinder head adjacent the ignition port outlet. The deflector surrounds the side of ignition port outlet closest to the fuel intake port and diverts lubricant and/or other heavy residuals collecting on the cylinder head around the ignition port outlet so as to minimize fouling of the spark plug.

5 Claims, 2 Drawing Figures

INTERNAL COMBUSTION ENGINE INCLUDING SPARK PLUG ANTI-FOULING MEANS

BACKGROUND OF THE INVENTION

This invention relates to internal combustion engines and, more particularly, to internal combustion engines including means for minimizing spark plug fouling.

The electrode of spark plugs for an internal combustion engine can be carbonized or fouled when oil or similar materials flows in direct contact therewith. This fouling problem is partilcuarly prevelant in two-cycle engines employing a fuel-lubricant charge and wherein the spark plug is located on the exhaust side of the cylinder. As an uncombusted portion of the fuel-lubricant mixture flows across the cylinder from the intake port to the exhuast port, some of the lubricant and/or other heavy residuals tend to separate from the mixture and collect on the cylinder head, particularly during slow and idling speeds. If the spark plug electrodes extend to the cylinder combustion chamber or otherwise are directly exposed to the combustion chamber, the collected residuals can contact the electrodes and cause fouling and a resultant improper firing within a relatively short period of time.

Representative examples of prior art arrangements for minimizing spark plug fouling are disclosed in French Pat. No. 842,398 and the following United States patents:

- Shepherd U.S. Pat. No. 1,552,551—issued Jan. 13, 1925
- Metailler U.S. Pat. No. 2,057,390—issued Oct. 13, 1936
- Warner U.S. Pat. No. 3,710,722—issued July 16, 1973
- Leonard et al U.S. Pat. No. 3,930,471—issued Jan. 6, 1976
- Seufer et al U.S. Pat. No. 3,941,097—issued Mar. 2, 1976

SUMMARY OF THE INVENTION

The internal combustion engine provided by the invention comprises an engine block including a cylinder having a head, a piston mounted for reciprocative movement inside the cylinder and cooperating therewith to form a combustion chamber, an intake port in the cylinder through which a fuel-lubricant mixture is admitted into said combustion chamber for combustion, an ignition port located in the cylinder head and including an outlet opening into the combustion chamber, a spark plug mounted in the ignition port, and deflector means located on the cylinder head adjacent the ignition port outlet for diverting lubricants and/or other heavy residuals collecting on the cylinder head around the ignition port outlet. The deflector means extends inwardly from the cylinder head into the combustion chamber and includes a flow diverting portion disposed between the ignition port outlet and the intake port.

In a preferred embodiment, the deflector means has a pointed, central portion which is disposed between the ignition port outlet and the intake port and a pair of legs which extend in diverging relationship and at an inward incline from the central portion to locations on the opposite sides of and adjacent the ignition port outlet so as to surround the side of the ignition port outlet closest to the intake port. The ignition port preferably is arranged so that the spark plug electrodes extend into the combustion chamber and the deflector means is arranged to provide unrestricted exposure of the electrodes to the combustion chamber.

One of the principal features of the invention is the provision of an internal combustion engine including deflector means for shielding spark plug electrodes against contact by lubricant or other heavy residuals collecting on the cylinder head.

Another of the principal features of the invention is the provision of an internal combustion engine including such a deflector means which minimizes spark plug fouling without adversely affecting ignition efficiency.

Other features, and advantages of the embodiments of the invention will become apparent upon reviewing the following detailed description, the drawing, and the appended claims.

Figure 1:
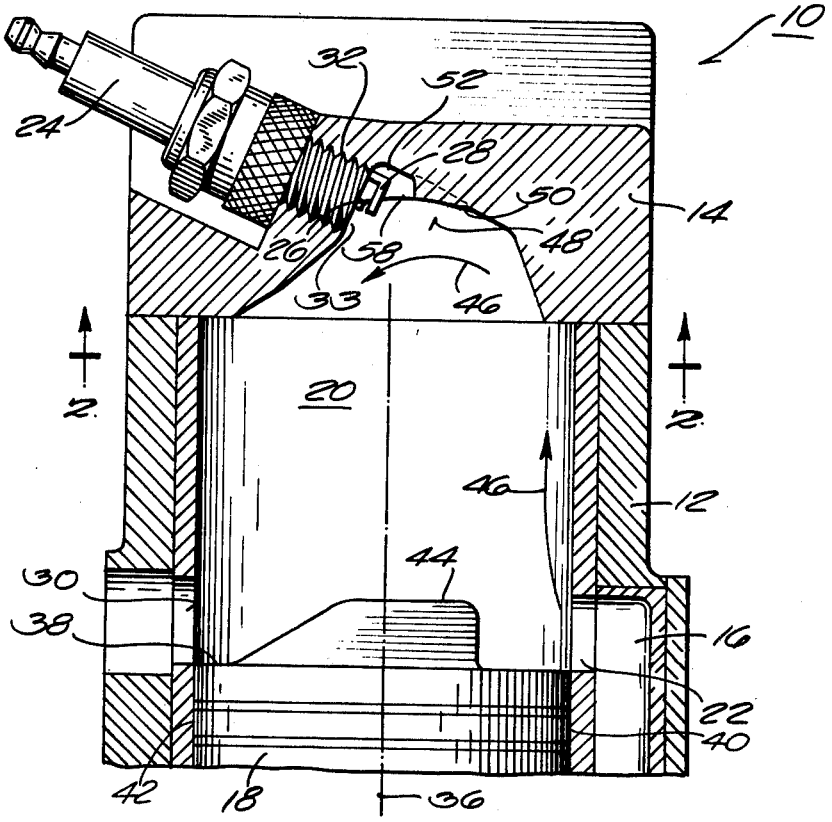
FIG. 1 is a fragmentary, partially sectioned, side elevation view of an internal combustion engine embodying various of the features of the invention.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Illustrated in the drawing is an engine block 10 (shown fragmentarily) for a two-cycle internal combustion engine. The engine block 10 includes one or more cylinders 12, each having a cylinder head 14 including an internal surface generally of dome shape, a cylindrically shaped side wall extending from the head 14, and a suitable transfer passage 16 which is located on one side of the cylinder 12 and is connected in communication with the engine crankcase (not shown).

Mounted for reciprocative movement inside the cylinder 12 is a piston 18 (shown fragmentarily) which is connected to the engine crankshaft by a suitable connecting rod (neither shown). The piston 18 cooperates with the cylinder 12 to form a combustion chamber 20.

A combustible charge comprising a fuel-lubricant-air mixture is introduced into the combustion chamber 20 through one or more intake ports 22 provided in the cylinder 12 and connected in communication with the transfer passage 16. The fuel-lubricant-air mixture is compressed in the combustion chamber 20 during the upstroke or compression stroke of the piston 18 and is ignited therein by a spark plug 24 mounted in the cylinder head 14 and having conventional spaced electrodes 26 and 28. During the subsequent downstroke or expansion stroke of the piston 18, the combustion products are exhausted from the combustion chamber 20 through one or more exhaust ports 30 provided in the cylinder 12 generally opposite to the intake port 22.

Figure 2:
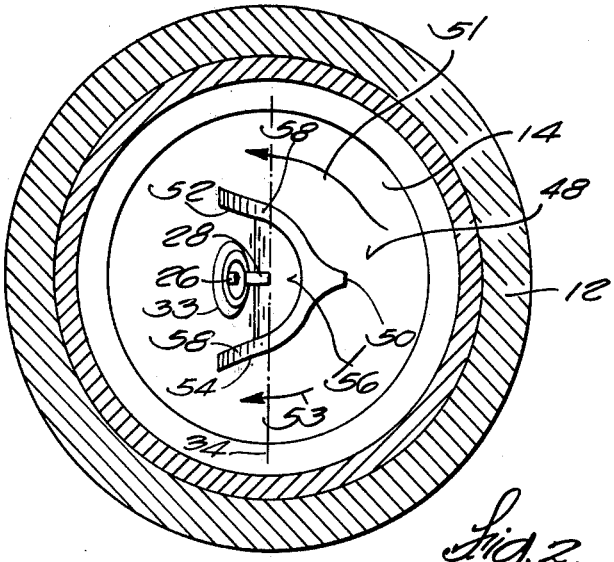
FIG. 2 is a sectional plan view taken along the line 2—2 in FIG. 1.

While various other arrangements can be employed, in the specific construction illustrated, the spark plug 24 is threadably mounted in an ignition port 32 having an outlet 33 opening through the dome-shaped surface of the head into the combustion chamber 20. The ignition port 32 is located between the exhaust port 30 and a diametric medial plane between the intake port 22 and the exhaust port 30 (represented by reference numeral 34 in FIG. 2) and is disposed at an acute angle to the longitudinal or axial center line of the cylinder 12 (represented by the reference numeral 36 in FIG. 1).

The piston 18 includes a work surface or top 38 and further includes an inlet face portion 40 and an outlet face portion 42 which respectively cover and uncover the intake port 22 and the exhaust port 30 as the piston 18 reciprocates during engine operation. The upper edge of the exhaust port 30 preferably is located closer to the cylinder head 14 than the upper edge of the intake port 22 so that the piston 18 uncovers the exhaust port first during the downstroke, thereby releasing the pressure in the cylinder 12 before the intake port is uncovered to admit a fresh charge.

As the intake port 22 is uncovered during the downstroke of the piston 18, a portion of the fresh charge flowing through the intake port 22 is diverted towards the cylinder head 14 by a baffle or deflector 44 carried on the piston top 38. An uncombusted portion of the fresh charge flows across the cylinder 12 adjacent the cylinder head 14 and then downwardly towards the exhaust port 30 to push the exhaust products from the combustion chamber 20 through the exhaust port. This flow pattern is represented by the arrows 46 in FIG. 1.

As the uncombusted charge flows through the combustion chamber 20, there is a tendency for some of the lubricant and/or other heavy residuals to separate therefrom and collect on the cylinder head 14, particularly during low speed or idling conditions. Ordinarily, these heavy residuals eventually would flow into the area surrounding the spark plug electrodes 26 and 28 or into direct contact with the electrodes. In such event, the spark plug electrodes can become carbonized or fouled within a relatively short period of time with a resulting improper firing.

This potential spark plug fouling problem is alleviated by providing a deflector means which is located adjacent the ignition port outlet 33 and is arranged to divert any thus-collected lubricant and/or other heavy residuals around the ignition port outlet 33 and, thus, radially outwardly around the spark plug electrodes 26 and 28.

More specifically, such deflector means includes a generally V-shaped deflector 48 which extends towards the combustion chamber from the dome-shaped internal surface of the head 14. The deflector 48 includes a pointed, central portion 50 which is disposed between the ignition port outlet 33 and the intake port 22 and is located in the flow path of the charge flowing adjacent the cylinder head 14 and in the vicinity of the ignition port outlet 33. The central portion 50 diverts the flow into separate streams (represented by reference numerals 51 and 53 in FIG. 2). The deflector 48 also includes a pair of legs 52 and 54 which extend from the central portion 50 in diverging relationship to either side of the ignition port outlet 33 and which extend inwardly towards the combustion chamber from the internal surface of the dome-shaped head 14, and at an inward incline from the central portion 50 to locations on the opposite sides of the ignition port outlet 33, which incline constitutes a ramp or innermost surface 58 which is located a distance inwardly of the combustion chamber from the internal surface of the dome-shaped head 14 and which increases in distance from the internal surface of the dome-shaped head in the direction away from the central portion 50.

With this arrangement, the deflector 48 in effect surrounds the upstream portion of the ignition port outlet 33, i.e., the side of the ignition outlet port closest to the intake port 22, and thereby shields the spark plug electrodes 26 and 28 from any lubricant and/or other heavy residuals which collect on the cylinder head 14 and which otherwise would come into contact with the electrodes by gravity flow or by the force of gases flowing through the combustion chamber. On the other hand, the opening 56 between the deflector legs 52 and 54 (FIG. 2) is sufficiently large to provide substantially unrestricted exposure of the spark plug electrodes 26 and 28 to the combustion chamber 20.

To maximize ignition efficiency, the innermost surfaces 58 of the deflector legs 52 and 54 preferably are arranged so that the spark plug electrodes 26 and 28 extend inwardly beyond these surfaces. This minimizes the chances of a void area being formed adjacent the spark plug electrodes, i.e., an area devoid or substantially devoid of combustible gases. In the specific construction illustrated, the innermost surfaces 58 of the deflector legs 52 and 54 are provided with a concave contour so as to provide the legs with a sufficient height to guide the lubricant and/or other heavy residuals, diverted by the central portion 50, radially outwardly around the spark plug electrodes 26 and 28 and yet permit full exposure of the spark plug electrodes to the combustion chamber 20 for maximum ignition efficiency.

It should be understood that the deflector 48 can be arranged so that the spark plug electrodes are shielded from any substantial direct contact by any portion of the liquid charge flowing therepast, in which case the height of the legs 52 and 54 is increased to extend inwardly beyond the spark plug electrodes. Also, the spark plug can be recessed inside the ignition port so that the electrodes are spaced from the combustion chamber, in which case the height of the deflector legs 52 and 54 can be decreased. Such arrangements are less desirable because of the tendency to form a void area which might reduce ignition efficiency. While the deflector 48 has been described in connection with a spark plug located on the exhaust side of the cylinder, it can also be employed in engines having spark plugs centrally located in the cylinder head or located on the intake side of the cylinder.

Various of the features of the invention are set forth in the following claims.

What is claimed is:

1. An internal combustion engine including an engine block, a cylinder in said engine block and having a generally dome-shaped head and a cylindrically shaped side wall extending from said dome-shaped head, a piston mounted for reciprocative movement inside said cylinder and cooperating therewith to form a combustion chamber, an intake port in said cylinder side wall through which a fuel-lubricant mixture is admitted into said combustion chamber for combustion, an ignition port located in said cylinder head and including an outlet opening into said combustion chamber, and deflector means on said cylinder head adjacent said ignition port outlet for diverting around said ignition port outlet, lubricants and/or other heavy residuals carried by the incoming fuel-lubricant mixture flowing from said intake port toward said ignition port, said deflector means extending from said cylinder head downwardly into said combustion chamber and including a flow diverting portion disposed between said ignition port outlet and said intake port.

2. An internal combustion engine according to claim 1 wherein said flow diverting portion includes a pointed, central portion disposed between said ignition port outlet and said intake port, and a pair of legs extending in diverging relationship and at an inward incline from said central portion to locations on the opposite sides of and adjacent said ignition port outlet so as to surround the side of said ignition port outlet closest to said intake port.

3. An internal combustion engine including an engine block, a cylinder in said engine block and having a head, a piston mounted for reciprocative movement inside said cylinder and cooperating therewith to form a combustion chamber, an intake port in said cylinder through which a fuel-lubricant mixture is admitted into said combustion chamber for combustion, an ignition port located in said cylinder head and including an outlet opening into said combustion chamber, and deflector means on said cylinder head adjacent said ignition port outlet for diverting around said ignition port outlet, lubricants and/or other heavy residuals carried by the incoming fuel-lubricant mixture from said intake port toward said ignition port, said deflector means extending from said cylinder head downwardly into said combustion chamber and including a flow diverting portion disposed between said ignition port outlet and said intake port, said flow diverting portion including a pointed, central portion disposed between said ignition port outlet and said intake port, and a pair of legs extending in diverging relationship and at an inward incline from said central portion to locations on the opposite sides of and adjacent said ignition port outlet so as to surround the side of said ignition port outlet closest to said intake port, each of said deflector legs including an innermost surface and further including a spark plug mounted in said ignition port and having electrodes extending inwardly into said combustion chamber beyond said innermost surfaces of said deflector legs.

4. An internal combustion engine according to claim 3 including an exhaust port in said cylinder generally opposite said intake port and through which combustion products are exhausted from said combustion chamber, and wherein said ignition port is located between said exhaust port and a diametric medial plane between said intake port and said exhaust port and at an acute angle relative to the longitudinal center line of said cylinder.

5. An internal combustion engine including an engine block, a cylinder in said engine block and having a head, a piston mounted for reciprocative movement inside said cylinder and cooperating therewith to form a combustion chamber, an intake port in said cylinder through which a fuel-lubricant mixture is admitted into said combustion chamber for combustion, an ignition port located in said cylinder head and including an outlet opening into said combustion chamber, and deflector means on said cylinder head adjacent said ignition port outlet for diverting around said ignition port outlet, lubricants and/or other heavy residuals carried by the incoming fuel-lubricant mixture from said intake port toward said ignition port, said deflector means extending inwardly from said cylinder head into said combustion chamber and including a flow diverting portion disposed between said ignition port outlet and said intake port, said flow diverting portion including a pointed, central portion disposed between said ignition port outlet and said intake port, and a pair of legs extending in diverging relationship and at an inward incline from said central portion to locations on the opposite sides of and adjacent said ignition port outlet so as to surround the side of said ignition port outlet closest to said intake port, each of said deflector legs including an innermost surface having a concave contour.

* * * * *